United States Patent [19]

Minegishi et al.

[11] Patent Number: 4,742,209

[45] Date of Patent: May 3, 1988

[54] GLOW PLUG FOR DIESEL ENGINE

[75] Inventors: Sokichi Minegishi; Mitusuke Masaka; Koji Hatanaka, all of Higashimatsuyama; Kenzi Maruta; Hirohisa Suwabe, both of Kumagaya, all of Japan

[73] Assignees: Jidosha Kiki Co., Ltd.; Hitachi Metals, Ltd., both of Tokyo, Japan

[21] Appl. No.: 873,668

[22] Filed: Jun. 12, 1986

[30] Foreign Application Priority Data

Jun. 27, 1985 [JP] Japan ..... 60-139118

[51] Int. Cl.[4] ..... F02N 17/00; F23Q 7/22

[52] U.S. Cl. ..... 219/270; 219/541; 219/523; 219/553; 123/145 A; 123/179 H

[58] Field of Search ..... 219/267, 268, 270, 523, 219/553, 541; 338/326, 327, 330; 123/145 A

[56] References Cited

U.S. PATENT DOCUMENTS

| | | | |
|---|---|---|---|
| 4,357,526 | 11/1982 | Yamamoto et al. | 219/270 |
| 4,401,065 | 8/1983 | Minegishi et al. | 219/270 |
| 4,598,676 | 7/1986 | Ito et al. | 219/270 |

FOREIGN PATENT DOCUMENTS

| | | | |
|---|---|---|---|
| 0007198 | 1/1980 | European Pat. Off. | 219/270 |
| 0150716 | 9/1983 | Japan | 219/270 |
| 0609085 | 1/1985 | Japan . | |
| 60-14784 | 1/1985 | Japan . | |
| 2015225 | 1/1981 | United Kingdom | 219/270 |

*Primary Examiner*—M. H. Paschall

*Attorney, Agent, or Firm*—Townsend & Townsend

[57] ABSTRACT

There is disclosed glow plug for a diesel engine provided with an elongated ceramic heater retained by an opening end of a hollow holder with one end of said ceramic heater being projected toward the outside. The ceramic heater comprises an insulating tubular section of an insulating ceramic material, and a heating body as a continuous conductive section formed so as to cover the outer peripheral portion, the outermost portion and the hollow portion of the insulating tubular section with a conductive ceramic material, the heating body being formed in a manner that the thickness of at least the outer peripheral portion of the insulating tubular member in the vicinity of said one end of the ceramic heater is thinner than that of other portions thereof. The insulating tubular section and the heating body constituting the ceramic heater are integrally formed with the ceramic material which can select insulating property and conductive property by adjusting an amount of titanium nitride added into $\beta$-sialon or a sialon consisting of a mixture of $\alpha$- and $\beta$- sialons. Thus, there is provided a glow plug provided with a ceramic heater which exhibits a function as a heater of the rapid heating type and provide a self-temperature saturation characteristic such that its heating characteristic can be improved to attain after glow for a long time.

10 Claims, 3 Drawing Sheets

GLOW PLUG FOR DIESEL ENGINE

BACKGROUND OF THE INVENTION

The present invention relates to a glow plug used for preheating the interior of an auxiliary combustion chamber or a combustion chamber of a diesel engine. Specifically, the present invention is concerned with an improvement in a glow plug for a diesel engine provided with a ceremic heater which exhibits a function as a heater of the rapid heating type and provide a self-temperature saturation characteristic such that its heating characteristic can be improved to attain a long time after glow.

In general, since diesel engines have poor startability at a low temperature, there is employed a method to provide a glow plug within an auxiliary combustion chamber or a combustion chamber to heat the glow plug by passing a current therethrough, thereby to elevate an intake temperature or use it as an igniting source, thus to improve the startability of the engine. Hitherto, there have been ordinarily used glow plugs so called "sheath type plugs" wherein heat-resisting insulating powder is filled into a metalic sheath, allowing a coil-shaped heating wire of iron, chromium or nickel etc. to be embedded thereinto. In addition, glow plugs of ceramic heater type as shown in the U.S. Pat. No. 4,401,065 etc. have been known wherein there is used a rod-shaped heater formed by embedding a heating wire of tungsten etc. into a ceramic material such as a silicon nitride having insulating property. When compared with the glow plugs of the sheath type effecting indirect heating through the heat-resisting insulating powder and the sheath, such glow plugs of the ceramic heater type can provide improved heat transmission efficiency and excellent heating characteristic such that they are red-heated in a short time at the time of heating to improve temperature rising characteristic, thus exhibiting the performance as a heater of the rapid heating type. For this reason, such ceramic heater type glow plugs have been widely employed in recent years.

However, the drawbacks with these glow plugs of the ceramic heater type are as follows. They have a heater structure provided with the metallic heating wire (of tungsten) embedded into the insulating ceramic material e.g., silicon nitride etc., and thermal expansion coefficients of the both members are different from each other. As a result, they have a steep temperature gradient within the heater. There is the possibility that particularly rapid temperature rising at the time of heating and repetition of such a use would have bad influence upon durability of the ceramic heater, giving rise to problem in the reliability such as heat-resisting strength and high cost thereof.

To eliminate such problems, there has been proposed in the art a ceramic heater structure as shown in the Japanese patent pre-publication Nos. 60-9085 or 60-14784 etc. wherein a heating wire is formed with a conductive ceramic material having substantially the same as that of a ceramic material having insulating property. However, these ceramic heaters are questionable when used as a glow plug from structual and functional points of view, resulting in being beyond practical use.

For instance, the ceramic heater of the former has a structure provided with a conductive ceramic material serving as heating element embedded into an insulating ceramic material. Although this structure has a thermal transmission coefficient which is superior to that of the sheath type, it is questionable in exhibiting the function as the heater of the rapid heating type because of indirect heating. On the other hand, the ceramic heater of the latter is configured so that its heating element is exposed to the heater surface, thus making it possible to provide the function as the heater of the rapid heating type. However, since its heat element is formed as a stacked layer structure comprising simple U-shaped members and both ends of the heat element are simply guided to the heater rear end, the electrode leading-out structure becomes complicated, resulting in high cost. Further, the U-shaped heat element has a bad effect upon vortex flow into the combustion chamber, giving rise to problem in practical use.

Recently, glow plugs of this kind are strongly required in their market to employ so called "after glow system" for improving startability of diesel engine and durability with respect to the use at a high temperature resulting from the fact that the use of the diesel engine as a turbo engine is popularized to maintain the glow plug in an energized condition for a preselected time after the engine starts, thereby to smoothly and properly effect combustion within the engine, thus taking an exhaust and noise countermeasure. In addition, it is required to prolong this after glow time as long as possible (e.g., about ten minutes). To realize such a long time after glow, it is also required to self-control power delivered to the heat element to improve the heating characteristic to much extent to prevent overheat at the heater portion, and to have self-temperature saturation funtion to maintain the saturation temperature at a value less than a suitable temperature. Taking into account these matters, it is now expected to realize a glow plug provided with an inexpensive ceramic heater which has rapid heating property and self-temperature saturation characteristic etc., and which is excellent in regard to reliability such as heat-resisting strength etc.

SUMMARY OF THE INVENTION

With the above in mind, an object of the present invention is to provide a glow plug having an improved reliability such as heat-resisting strength etc.

Another object of the present invention is to provide a glow plug capable of sufficiently exhibiting performance as a heater of rapid heating type.

A further object of the present invention is to provide a glow plug which can suitably control the peak temperature and the saturation temperature by making use of the self-temperature saturation characteristic.

To achieve these objects, there is provided a glow plug for a diesel engine provided with an elongated ceramic heater retained by an opening end of a hollow holder with one end of the ceramic heater being projected toward the outside, the ceramic heater comprising an insulating hollow tubular section of an insulating ceramic material, and a heating body as a continuous conductive section formed so as to cover the outer peripheral portion, the outermost portion and the hollow portion of the insulating tubular section with a conductive ceramic material, the heating body being formed in such a manner that the thickness of at least the outer peripheral portion of the insulating tubular member in the vicinity of the one end of said ceramic heater is thinner than that of other portions thereof. The insulating tubular section and the heating body constituting the ceramic heater are integrally formed with the ceramic material which can select insulating property and conductive property by adjusting an amount of titanium nitride added into β-sialon or a sialon consisting of a mixture of α and β-sialons.

BRIEF DESCRIPTION OF THE DRAWINGS

The features and advantages of a glow plug for a diesel engine according to the present invenion will become more apparent from the following description taken in conjunction with the accompanying drawings, in which.

DETAILED DESCRIPTION OF PREFERRED EMBODIMENTS

Figure 1:
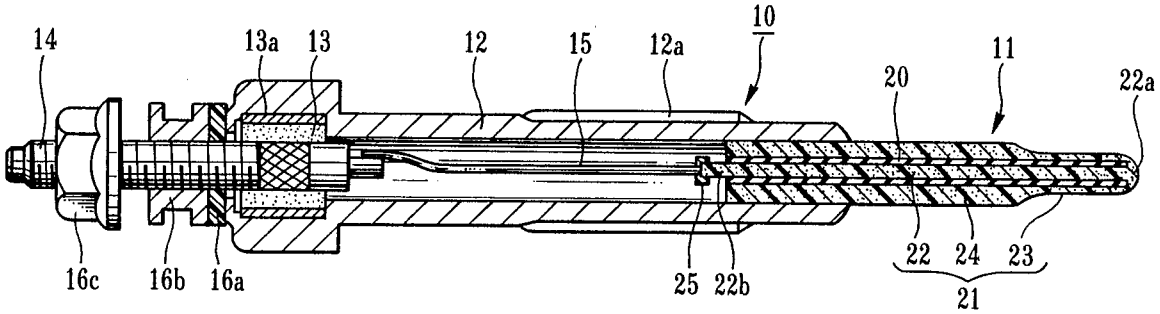
FIG. 1 is a logitudinal cross sectional view illustrating an embodiment of a glow plug for a diesel engine according to the present invention.

Initially, an embodiment of a glow plug for a diesel engine according to the present invention will be described in detail with reference to FIGS. 1 to 3. A glow plug 10 is provided with a rod-shaped ceramic heater 11 having an end portion functioning as a heating portion, and a substantially tubular or hollow metallic holder 12 holding the ceramic heater 11 at its opening end. An external connection terminal 14 is concentrically fitted and retained into the rear portion of the holder 12 through an insulating bush 13 of synthetic resin etc. The external terminal 14 is connected to the side of a heating body 21 (which will be described later) within the ceramic heater 11. Over the outer peripheral portion of the insulating bush 13, a metallic pipe **13*a* is integrally fitted. This metallic pipe 13*a* is buckled and deformed in an axial direction of the holder 12 due to a large force applied by the back end of the holder 12 caulked when assembling to allow the insulating bush 13 to be integrated with the holder 12 by a required mechanical strength, thereby providing a structure which is hardly affected by temperature. Over a threaded portion at the back end of the external connection terminal 14, an insulating ring 16*a*, a fixing nut 16*b*, and a nut 16*c* for fastening an external lead are screw-threadedly fitted. By putting a lead wire from a battery (not shown) between nuts 16*b* and 16*c*, the external connecting terminal 14 is electrically connected to a battery terminal. The holder 12 is provided for screw-threadedly fitting a threaded portion 12*a* formed on the outer peripheral portion thereof into a threaded hole formed in a cylinder head of an engine (not shown), thus allowing the glow plug to be earth-connected, and for disposing the glow plug in a manner that the leading end of the heater 11** projects into the auxiliary combustion chamber or the combustion chamber.

The reason why the ceramic heater 11 is connected to the external connection terminal 14 by means of the metal lead wire 15 is to protect the heater 11 from various vibrations or mechanical force e.g. fastening torque etc. applied to the external connection terminal 14. The lead wire may be formed with material having flexibility to some extent.

Figure 2:
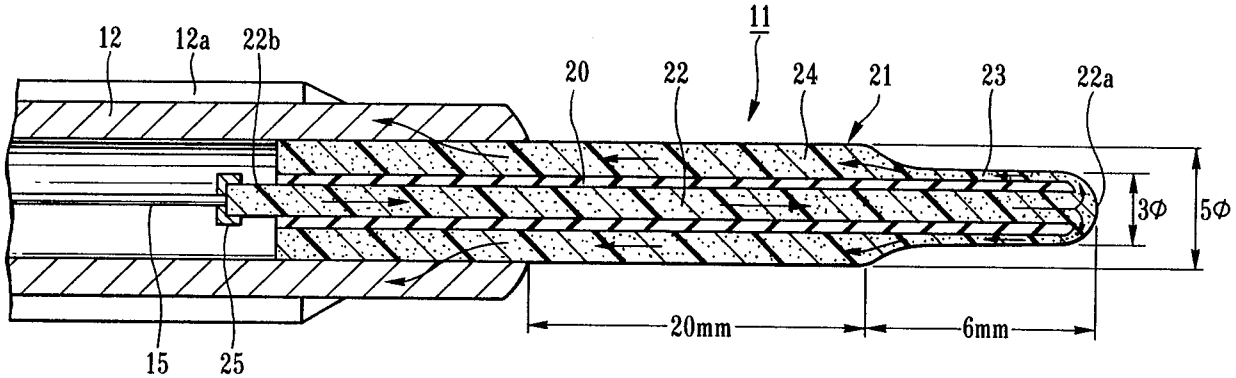
FIG. 2 is an enlarged cross section of an essential part of the glow plug shown in FIG. 1.
Figure 3:
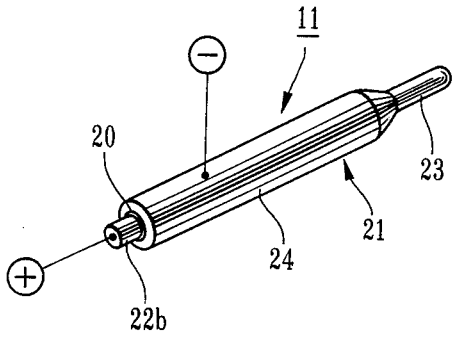
FIG. 3 is a perspective view schematically illustrating a rod-shaped ceramic heater which is essential to the glow plug shown in FIG. 1.

In the glow plug thus configured, as seen from FIGS. 1 and 2, the present invetnion is characterized in that the rod-shaped ceramic heater 11 retained at the opening end portion of the holder 12 is formed with an insulating tubular section 20 formed of an insulating ceramic material, and a heating body 21 of a conductive ceramic material integrally formed so as to cover the inner and outer peripheral portions and the end portion of the insulating tubular section 20, and that at least the outer peripheral portion at the side of the end portion of the heater 11 has a thickness thinner than that of other portions.

More particularly, the ceramic heater 11 in this embodiment is provided with the heating body 21 integrally formed as a continuous conductive section comprising a plus lead portion 22 filled into the elongated insulating tubular section 20 formed with insulating ceramic material, the plus lead portion 22 having one end portion **22*a* turned over toward the outer peripheral side of the insulating tubular member 20 and the other end portion 22*b* serving as a lead connection terminal projected backward from the insulating tubular member 20, a radially small-sized heating portion 23 contiguous to the plus lead portion 22 and formed onto the outer peripheral portion at the side of the end portion of the insulating tubular section 20 so as to have a thin thickness (e.g. 0.3 mm), and a radially large-sized minus lead portion 24 contiguous to the heating portion 23 formed onto the outer peripheral portion of the insulating tubular section 20 so as to extend to the other end thereof, the minus lead portion 24 having a thickness larger than that of the heating portion 23. Further, at the lead connection terminal 22*b* provided at the other end portion of the plus lead portion 22, the one end portion of the metallic lead wire 15 is connected to the side of a power source through a cap 25. The outer periphery of the minus lead portion 24 provided at the side of the other end of the heater 11 is earth-connected by fixing the minus lead portion 24 to the holder 12 through a metallized layer etc. (not shown) with it being retained thereby. When the ceramic heater 11 thus configured is employed, it is experimentarily confirmed that the setting of the respective dimensions thereof is preferably made as follows: the heating portion 23 has a diameter of 3 mm and an axial length of 6 mm, and the lead portion 24 has a diameter of 5 mm and a length projected from the holder 12** of 20 mm.

Further, for the insulating and conductive ceramic materials forming the above-mentioned ceramic heater 11, there may be employed a SIALON etc. which can select insulating or conductive property by adjusting what amount of titanium nitride (TiN) is added to e.g. a β-SIALON or a SIALON in which α- and β- SIALONs are mixed. The employment of such a SIALON can form the insulating tubular section 20 and the heating member 21 by using the similar materials having the same thermal expansion coefficients, thus providing an enhanced joining strength to improve reliability such as heat resisting strength. Namely, it has been confirmed that an addition of more than about twenty percentages of titanium nitride (TiN) into the above-mentioned SIALON provides conductive property (so called a "conductive SIALON"). It is also known that resistance value continuously varies by further adding titanium nitride. Accordingly, it is seen that SIALON having a suitable content ratio of the titanium nitride can be utilized. In addition, by sintering the insulating and conductive ceramic materials using the above-mentioned SIALON through oxide sintering additives such as $Y_2O_3$, poly type AlN, and $Al_2O_3$, it is strongly joined with a bonding layer being formed in its joining portion.

However, the insulating and conductive ceramic materials forming the insulating tubular section 20 and the heating body 21 are not limited to the above-mentioned SIALON. It is possible to use any ceramic material which is stable in its performance in a high temperature condition (e.g. up to about 1200° C.) and is excellent in the heat-resisting impact property. In this instance, for the conductive ceramic material forming the heating body 21, there may be used a sintered material containing one or more materials selected from a group of non-oxide conductive materials such as carbide, boride or nitride etc. belonging to group 4*a*, 5*a* or 6*a* of the periodic table, and SiC (silicon carbide) and Al (aluminum) or Al compound serving as its centering binder. Further, for the insulating ceramic material forming the insulating tubular member 20, there may be used a material containing, as its major component, SiC, $Si_3N_4$, AlN or $Al_2O_3$ etc., which is excellent both in the heat-resisting strength etc. and the joining strength with respect to the heating body 21.

As previously described, the conventional glow plug is of internal heating type in which a heating wire is embedded into the sheath or the insulating ceramic material, failing to provide a rapid heating function. However, the glow plug according to the present invention can solve the drawback with the conventional one by allowing the heating body 21 to be exposed to the outer surface of the ceramic heater 11, thus providing an improved heating characteristic. It is readily understood from the following description that such an advantage can be obtained when the ceramic heater of the invention is employed. Namely, the ceramic heater 11 according to the present invention has a structure such that the heating portion 23 of the heating section 21 is exposed to the surface at the side of the end portion of the heater 11 and at the same time extends to the internal portion thereof. Accordingly, the ceramic heater 11 according to this invention can be said as an internal and external heating type when compared to the conventional ceramic heater of the internal heating type.

Further, the heating body 21 and the insulating tubular section 20 constituting the ceramic heater 11 of the invention are formed with ceramic materials having substantially the same thermal expansion coefficients, respectively, and these members are integrally formed by suitably and securely joining them to each other. Accordingly, this can eliminate bad influence on the durability such as the occurence of cracks due to rapid temperature elevation as in the conventional ceramic heater to improve reliability e.g., heat-resisting strength etc. to a great extent. Particularly, the ceramic heater 11 makes it possible to provide an excellent joining strength of both members when compared to the ceramic heater provided with the metallic heating wire embedded into the ceramic material, and to eliminate a lead portion for taking out the heating wire fromt the surface of the ceramic material.

Further, the ceramic heater 11 according to the present invention can adjust the specific resistance of the conductive SIALON forming the heating body 21 by an additive amount of titanium nitride, thus to desirably set the thickness. Particularly, this enables thinning of the thickness at the heating portion 23 to provide a rapid heating characteristic, and to effect a suitable control of saturation temperature to realize after glow over a long time. Namely, such a self-temperature saturation characteristic is obtained by the relationship between volume (cross section) of the heating portion 23 and volume of the lead portions 22 and 24. In addition, the heating section 21 is formed with the conductive ceramic material, with the result that shaping and machining or durability etc. is excellent when compared to the conventional metallic heating wire. It is to be noted that the thickness etc. of each part of the above-mentioned heating member 21 can be adjusted e.g. by grinding, thus making it possible to desirably select the resistance value.

Moreover, the structure according to the above-mentioned embodiment can provide the retaining portion at the side of the earth with respect to the holder 12 of the ceramic heater 11 and the connection portion at the plus side with respect to the metallic lead wire 15 at the side of the back side portion spaced from the heating portion 23, thus making it possible to suitably and securely obtain joining strength with respect to the metallic material at a portion having a low temperature which has less influence of the heat from the heating portion 23.

Figure 5:
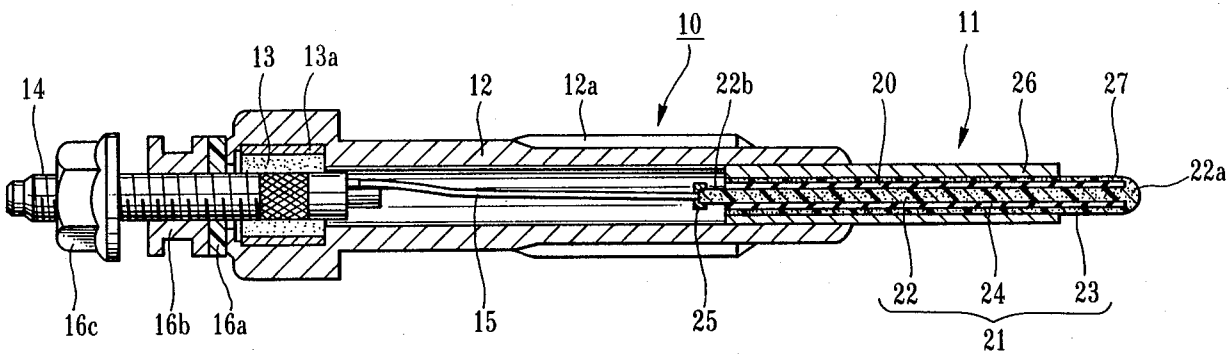
FIG. 5 is a logitudinal cross sectional view illustrating another embodiment of a glow plug for a diesel engine according to the present invention.

In the above-mentioned embodiment, there is illustrated the round rod-shaped ceramic heater 11 provided with small and large diameter portions having cross sections formed substantially circular, thus facilitating the shaping and machining process and assembling it into the holder 12. It is needless to say that the ceramic heater 11 is not limited to the one stated above. For instance, various modifications e.g. elliptical or rectangular ceramic heater etc. may be used. Further, there may be employed a structure as shown in FIG. 5 wherein the minus lead portion 24 is formed so that its thickness is the same as that of the heating portion 23, and the ceramic heater 11 is retained by the holder 12 through a metallic protective pipe 26.

Although explanation is omitted in the above-mentioned embodiment, when a protective film (designated at 27 in FIG. 5) having antioxidation property with respect to the heating portion 23 is formed on the extenal surface of the heater 11 by making use of a coating process such as vacuum deposition, a further improved durability etc. can be expected.

Figure 4:
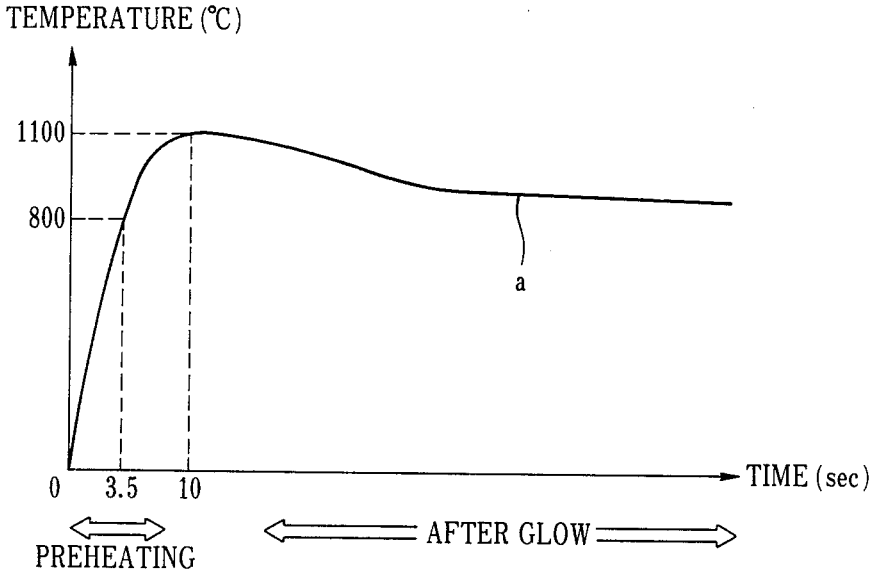
FIG. 4 is a graph showing a temperature characteristic of the rod-shaped ceramic heater employed in the present invention.

Thus, when there is used the ceramic heater 11 comprising the insulating tubular member 20 of the insulating ceramic material and the heating member 21 of the conductive ceramic material which are integrally formed with each other, an excellent characteristic for the glow plug 10 according to the present invention, it is experimentarily confirmed to realize that a time for arriving at 800° C. is 3.5 seconds, a peak temperature is about 1100° C. when its allowed temperature range is assumed to be less than 1200° C., and a saturation temperature is about 800° C., as indicated by the curve a in the FIG. 4.

The present invention is not limited to the structure in the above-described embodiments. It is possible to suitably modify or change the shape or structure of each part. For instance, there may be various modifications for the shape or structure of the ceramic heater 11, the connection structure of the electrode or the like.

As described in detail, the glow plug for diesel engine according to the present invention is provided with the rod-shaped ceramic heater retained at the top portion of the holder formed by integrally joining the insulating tubular section of the insulating ceramic material to the heating member of the conductive ceramic material contiguously so as to cover the internal and external peripheral portions and the top portion of the insulating tubular section, and the heating portion formed by thinning the thickness of at least the outer peripheral portion at the side of the top portion of the ceramic heater of the heating body. Accordingly, although the glow plug according to the present invention is of simple construction and inexpensive, since the heating portion is exposed to the external surface of the heater, it is possible to allow the top end of the heater to be rapidly and securely red-heated as compared to the conventional ceramic heater. Thus, this can exhibit the function of the rapid heating type and substantially equalize the thermal expansion coefficients of the insulating tubular member and the heating member, thereby providing an increased joining strength. As a result, even when there occurs rapid temperature elevation at the time of heating of the heater, there is not any influence, resulting in the occurence of cracks etc. Thus, reliability such as heat-resisting strength can be obtained. As a result, this enables long time after glow effective for exhaust and noise countermeasure, thus sufficiently exhibiting the performance of the glow plug. In addition, the glow plug according to the present invention is simple in the entire structure, and is excellent in the shaping and machining ability, assembling ability, heat-resisting strength and, durability sufficiently tolerable for severe use conditions.

What is claimed is:

1. A glow plug for a diesel engine provided with an elongated ceramic heater retained by an opening end of a hollow holder with one end of said ceramic heater being projected toward the outside, said ceramic heater comprising an electrically insulating tubular section of an insulating ceramic material, and a heating body as a continuous electrically conductive section formed so as to cover the outer peripheral portion, the outermost end portion and the hollow portion of said insulating tubular section with a conductive ceramic material, the thickness of at least the outer peripheral portion of said heating body in the vicinity of said one end of said ceramic heater being thinner than that of other portions thereof, said insulating tubular section and said heating body constituting said ceramic heater being integrally formed with a ceramic material having an insulating property and a conductive property selectable by adjusting the amount of the titanium nitride added into $\beta$- sialon or a sialon consisting of a mixture of $\alpha$- and $\beta$- sialons.

2. A glow plug as set forth in claim 1, wherein said insulating tubular member has substantially the same thermal expansion coefficient as that of said heating body.

3. A glow plug as set forth in claim 1, wherein said heating body comprises a first lead portion which is substantially the same length as the conductive section within said insulating tubular section, a heating portion formed by thinning the thickness of the conductive section on the outer peripheral surface of said insulating tubular section in the vicinity of said one end of said ceramic heater, and another lead portion which is substantially the same length as the conductive section on the outer peripheral surface of said insulating tubular section except for said heating portion.

4. A glow plug as set forth in claim 3, wherein said first lead portion has one end connected to a power source through a metallic lead wire within the hollow portion of said hollow holder.

5. A glow plug as set forth in claim 3, wherein said another lead portion is earth-connected.

6. A glow plug as set forth in claim 1, wherein said insulating tubular section and said heating body are joined by means of insulating and conductive ceramic materials of sialon using a sintering process implemented using sintering additives selected from the group consisting of $Y_2O_3$, poly type AlN, and $Al_2O_3$.

7. A glow plug as set forth in claim 3, wherein said ceramic heater has a self-temperature saturation characteristic determined by the relationship between the volume of said heating portion and the volumes of said lead portions.

8. A glow plug as set forth in claim 1, wherein said heating body includes a heating portion formed on the outer peripheral surface of said insulating tubular section in the vicinity of said one end of said ceramic heater, and a lead portion formed on the outer peripheral surface of said insulating tubular section except for said heating portion, said heating portion having the same thickness as that of said lead portion, said ceramic heater being retained by said hollow holder with a metallic protective pipe being interposed between said hollow holder and said lead portion.

9. A glow plug as set forth in claim 3, wherein a protective film having antioxidation property is formed on said heating portion.

10. A glow plug as set forth in claim 8, wherein a protective film having an antioxidation property is formed on said heating portion by making use of a coating process.

* * * * *